US011667851B1

(12) United States Patent
Franca et al.

(10) Patent No.: US 11,667,851 B1
(45) Date of Patent: Jun. 6, 2023

(54) NANOFORMULATIONS AND FUNCTIONALIZED POLYMERS FOR IRON REMOVAL FROM CRUDE OIL

(71) Applicant: Baker Hughes Oilfield Operations LLC, Houston, TX (US)

(72) Inventors: Leonardo Franca, Katy, TX (US); Tran M. Nguyen, Houston, TX (US); Brandon Vittur, Sugar Land, TX (US); Joseph Aresndorf, Conroe, TX (US); Radhika Suresh, Sugar Land, TX (US); Chad Pyle, Sugar Land, TX (US); Rostyslav Dolog, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/731,544

(22) Filed: Apr. 28, 2022

(51) Int. Cl.

| | |
|---|---|
| ***C10G 31/08*** | (2006.01) |
| ***C10G 33/02*** | (2006.01) |
| ***C10G 33/04*** | (2006.01) |

(52) U.S. Cl.
CPC ..... *C10G 31/08* (2013.01); *C10G 33/02* (2013.01); *C10G 33/04* (2013.01); *C10G 2300/1033* (2013.01); *C10G 2300/205* (2013.01); *C10G 2300/80* (2013.01)

(58) Field of Classification Search
CPC ..... C10G 31/08; C10G 33/02; C10G 33/04; C10G 2300/1033; C10G 2300/205; C10G 2300/80
See application file for complete search history.

(56) References Cited

U.S. PATENT DOCUMENTS

| | | | | |
|---|---|---|---|---|
| 2016/0208176 | A1* | 7/2016 | Barroeta | C10G 31/08 |
| 2018/0298290 | A1* | 10/2018 | Al Hamouz | B01J 20/327 |
| 2019/0240596 | A1* | 8/2019 | Less | C10G 33/02 |

FOREIGN PATENT DOCUMENTS

| | | | | |
|---|---|---|---|---|
| WO | WO-0052114 A1 * | 9/2000 | ..... | B01D 17/047 |

* cited by examiner

*Primary Examiner* — Randy Boyer
*Assistant Examiner* — Juan C Valencia
(74) *Attorney, Agent, or Firm* — Crowe & Dunlevy, P.C.

(57) ABSTRACT

It has been discovered that nanoparticles and/or functionalized polymers are effective in removing metal contaminants from a hydrocarbon phase into an aqueous phase. In particular, the nanoparticles and/or functionalized polymers can remove iron contaminants from crude oil into an aqueous phase in a refinery desalter. Suitable nanoparticles can include graphene oxide and/or titanium dioxide. Suitable functionalized polymers include iodododecane-functionalized vinylpyrrolidone/vinylimidazole copolymers, sulfonated-functionalized vinylpyrrolidone/vinylimidazole copolymers, sulfonated polyether ether ketones, imidazole polymers, imidazole copolymers, and/or 3-(1-pyridino)-1-propanesulfonate.

15 Claims, 4 Drawing Sheets

NANOFORMULATIONS AND FUNCTIONALIZED POLYMERS FOR IRON REMOVAL FROM CRUDE OIL

TECHNICAL FIELD

The present invention relates to methods and compositions for transferring metal contaminants in mixtures of a hydrocarbon phase and an aqueous phase from the hydrocarbon phase into the aqueous phase, and more particularly relates, in one non-limiting embodiment, to refinery desalting methods for transferring iron contaminants from the hydrocarbon phase into an aqueous phase and compositions thereof.

BACKGROUND

In industrial processes, there is often a need to transfer species from one place to another either to remove that species from the process as a contaminant, or to recover that species as a desirable product. In more complex processes, transferring different species can be done more than once in an effort to purify a particular product (e.g., removing one or more types of contaminants) or recovering a valuable product for later use or sale, for example in the recovery of metals from ore. The phase of the species, for instance, gas, liquid, or solid, will affect the processes used to move it from one place or another. For example, in the processing of liquids, solids can be considered contaminants and can thus be removed; for instance, by filtration.

In the non-limiting example of oil exploration and recovery, in an oil refinery, the desalting of crude oil has been practiced for many years. The crude is usually contaminated from several sources, including, but not necessarily limited to:

- Brine contamination in the crude oil as a result of the brine associated with the oil in the ground;
- Minerals, clay, silt, and sand from the formation around the oil well bore;
- Metals including calcium, zinc, silicon, nickel, sodium, potassium, etc.;
- Nitrogen-containing compounds such as amines used to scrub $H_2S$ from refinery gas streams in amine units, or from amines used as neutralizers in crude unit overhead systems, and also from $H_2S$ scavengers used in the oilfield; and
- Iron sulfides and iron oxides resulting from pipeline and vessel corrosion during production, transport, and storage.

The metals contained in crude oils often pose a challenge to refiners because they create costly operational challenges to the refining process, e.g., the poisoning of catalysts downstream. The metals may include, but not necessarily be limited to, those in Periodic Table Groups IA, IIA, IVA, IB, IIB, VB, VIB, and VIII. More particularly the metals include, but are not necessarily limited to, calcium, magnesium, iron, zinc, nickel, chromium, lead, cadmium, copper, and combinations thereof.

When crude oil is received by a refinery and before it is processed, contaminants such as salts and solids are removed in a process called "desalting". This process is conventionally unable to remove metals such as nickel, vanadium, and iron, and non-metallic contaminants such as phosphorus and sulfur. These are believed to be tightly bound to the hydrocarbons of the crude oil, e.g., vanadium bound in porphin rings. The forces necessary to break these bonds can be substantial, and the problem is made more complex when the metal is present in different oxidation states. New technologies to remove metal contaminants from crude oil are always being sought by the refining industry.

In the desalting process, wash water is mixed into the crude oil and then separated back out in a vessel called a desalter. The water separated back out is termed brine. Salts and other contaminants partition into the water and are removed with the brine in the desalter. The resulting crude oil (desalted crude) is greatly reduced in the levels of salts and other contaminants. Many of the problematic metals, however, do not partition into the water and thus are not removed in the desalter brine. They remain in the desalted crude and cause operational problems downstream in the refinery, such as fouling, deposits, corrosion, furnace coking, and catalyst poisoning.

Effective crude oil desalting can help minimize the effects of these contaminants on the crude unit and downstream operations. Proper desalter operations provide the following benefits to the refiner:

- Reduced crude unit corrosion.
- Reduced crude preheat system fouling.
- Reduced potential for distillation column damage.
- Reduced energy costs.
- Reduced downstream process and product contamination.

In more detail, desalting is the resolution of the natural emulsion of water that accompanies the crude oil by creating another emulsion in which about 5 percent relative wash water is dispersed into the oil using a mix valve. The emulsion mix is directed into a desalter vessel containing a parallel series of electrically charged plates. Under this arrangement, the oil and water emulsion is exposed to the applied electrical field. An induced dipole is formed on each water droplet within the emulsion that causes electrostatic attraction and coalescence of the water droplets into larger and larger droplets. Eventually, the emulsion resolves into two separate phases—the oil phase (top layer) and the water phase (bottom layer). The streams of desalted crude oil and effluent water are separately discharged from the desalter.

Often, chemical additives are injected before the mix valve to help resolve the oil/water emulsion in addition to the use of electrostatic coalescence. These additives effectively allow small water droplets to more easily coalesce by lowering the oil/water interfacial tension.

Much of the solids encountered during crude oil desalting consists of iron, most commonly as particulate iron such as iron oxide, iron sulfide, etc. Other metals that are desirably removed include, but are not necessarily limited to, calcium, zinc, silicon, nickel, sodium, potassium, and the like, and typically a number of these metals are present. Some of the metals may be present in a soluble form. The metals may be present in inorganic or organic forms. In addition to complicating the desalter operation, iron and other metals are of particular concern to further downstream processing. This includes the coking operation since iron and other metals remaining in the processed hydrocarbon yields a lower grade of coke. Removing the metals from the crude oil early in the hydrocarbon processing stages is desired to eventually yield high quality coke as well as to limit corrosion and fouling processing problems.

It would thus be desirable to develop compositions and methods employing them that would cause most or all of the metals from the crude oil and partitioning them into the water phase in a desalter operation, particularly the iron.

SUMMARY

There is provided, in one non-limiting form, a method of transferring metal contaminants from a hydrocarbon phase to a water phase in a refinery desalting process that includes adding to crude oil, a wash water, or an emulsion created by the mixing of crude oil with wash water, an effective amount of an additive composition to transfer metal contaminants from a hydrocarbon phase to an aqueous phase, the additive composition comprising an active additive selected from the group consisting of nanoparticles, functionalized polymers, and combinations thereof; and where the method further includes resolving the emulsion into the hydrocarbon phase and the aqueous phase in a refinery desalting process using electrostatic coalescence, where at least a portion of the metal contaminants are transferred to the aqueous phase.

In another non-limiting embodiment, there is provided a treated mixture including a hydrocarbon phase, an aqueous phase, metal contaminants, and an effective amount of an additive composition comprising an active additive selected from the group consisting of nanoparticles, functionalized polymers, and combinations thereof.

DETAILED DESCRIPTION

Figure 1:
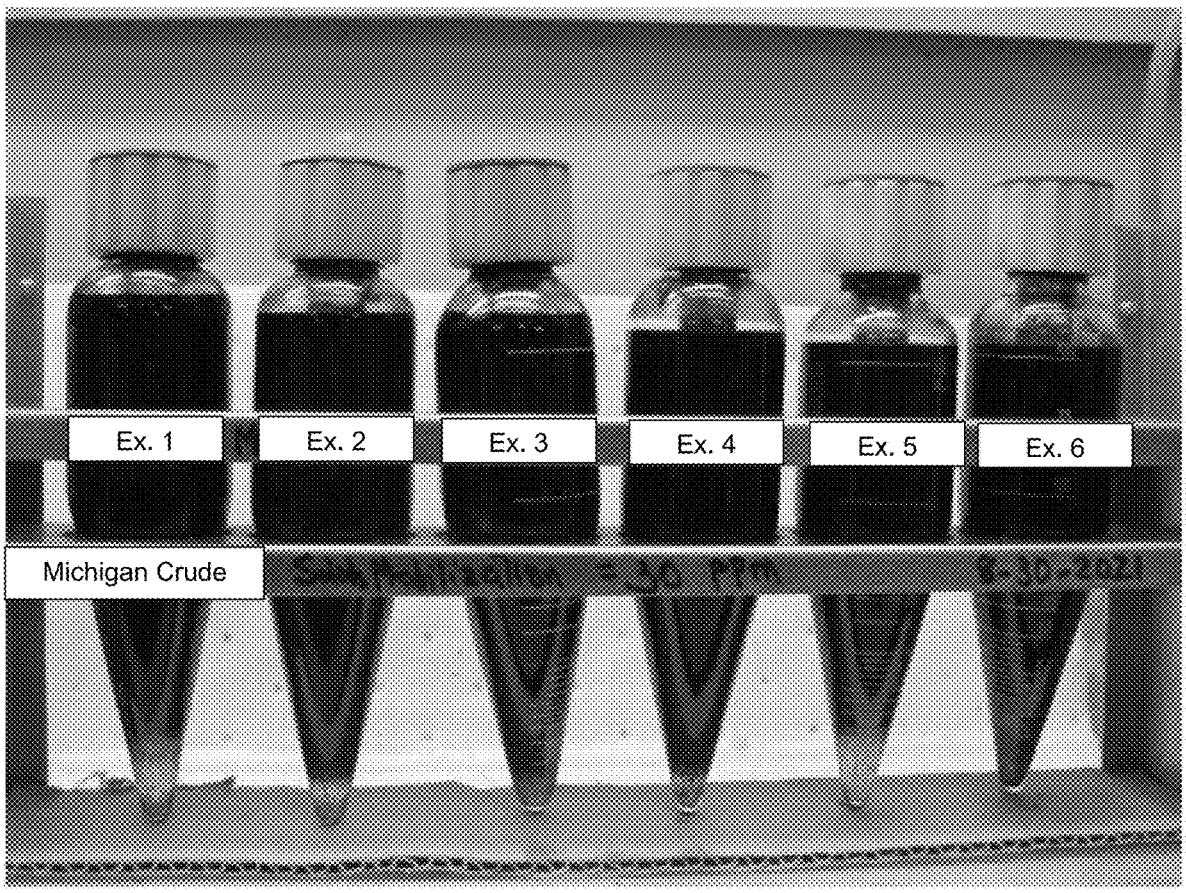
FIG. 1 is a photograph of the EDDA test tubes showing water separation for Examples 1 through 6.

It has been discovered that an active additive such as nanoformulations, nanoparticles, and/or functionalized polymers help remove problematic iron metal contaminants into a desalter brine when added to a desalter. A study was conducted that identified a group of nanoparticles and new functionalized polymers that can break complex emulsions present in the desalting processes and reduce the levels of problematic metals in the desalted crude.

As used herein, a nanoformulation refers to any additive or component that contains nanoscale materials, especially nanoparticles. Nanotechnology uses nanoscale materials that have properties different from larger, bulk scale materials. Nanoparticles have been found to be effective in demulsification and fluid separations for several reasons: size- and shape-dependent properties, high surface area compared to volume, presence of surface charge and polarity, and relatively higher charge density. In addition, nanoparticles are capable of penetrating into the oil/water interface, creating surface tension gradients, and/or interrupting the oil/water interfaces.

Current technology includes the use of demulsifiers that require relatively high dosages, and therefore relatively high cost, and which have the additional disadvantage of low metals removal efficiency. It has been discovered that the metals removal active additive components that include nanoparticles and/or functionalized polymers have good ability to remove salts, and in particular a good ability to reduce metals in desalted crude.

Nanoparticles and the novel functionalized polymers described herein are currently not being used in demulsification and metals removal in refinery desalting processes. Nanoparticles, functionalized polymers and some possible combinations of these technologies showed good metal removal efficiency, and in particular for iron, along with good water separation.

Suitable nanoparticles include, but are not necessarily limited to, graphene oxide, titanium dioxide, zinc oxide, aluminum nitride, aluminum oxide, functionalized clays, including but not limited to natural and functionalized phyllosilicates, and combinations thereof. In another non-limiting embodiment, suitable nanoparticles include ammonia-functionalized graphene oxide, $TiO_2$-functionalized graphene particles, and combinations of these. In one non-limiting embodiment, iron oxide nanoparticles were found to be ineffective in removing or partitioning metals from the crude oil into the brine; however, it may be that in the future iron oxide nanoparticles would be effective to removal metals under different conditions and/or in a different crude oil. Nanoparticles are generally defined herein as particles having an average particle size of 999 nm or less. In one non-limiting embodiment, the suitable nanoparticles herein have an average particle size ranging from about 1 nm independently to about 500 nm; alternatively, from about 10 nm independently to about 250 nm; and in another non-restrictive embodiment from about 30 independently to about 100 nm. As used herein with respect to a range, the word "independently" means that any endpoint may be used together with any other endpoint to give another suitable range. For example, an average particle size ranging from about 1 nm to about 100 nm would be acceptable.

Further, suitable nanoparticles for this application include those with functional groups including, such as hydrophobic groups, hydrophilic groups and their combinations. Particular nanoparticles useful as to partition metals include, but are not necessarily limited to, carbon nanotubes (including, but not limited to carbon nanotubes functionalized as described herein), functionalized silica, nanoparticles such as but not limited to magnesium oxide, barium sulfate and combinations thereof.

Nanoparticles believed to be useful in changing the wettability of metals to partition them into the brine include, but are not necessarily limited to, magnesium oxide, block copolymers, functionalized nanoclays, silicates and aluminas. Nanoparticles suitable to affect the wettability of solids may include, but are not necessarily limited to silica, magnesium oxide, copper oxide, zinc oxide, alumina, boron, carbon black, graphene, carbon nanotubes, functionalized silica, ferromagnetic nanoparticles, nanoplatelets, surface modified nanoparticles; which may be optionally functionalized with functional group including, but not necessarily limited to, sulfonate, sulfate, sulfosuccinate, thiosulfate, succinate, carboxylate, hydroxyl, glucoside, ethoxylate, propoxylate, phosphate, phosphonate, ethoxylate, ether, amines, amides and combinations thereof.

Nanoparticles that are bifunctional have been termed "Janus" particles because the functional groups on one side of nanoparticle are hydrophobic and the functional groups on the other side are hydrophilic. This bifunctionality is expected to exist with other nanoparticles such as carbon single-walled nanotubes (SWNTs) or multi-walled nanotubes (MWNTs) where one end of the tube has primarily or exclusively hydrophobic functional groups and the other end of the tube has primarily or exclusively hydrophilic functional groups. Such bifunctional nanoparticles, as well as nanoparticles which carry a charge, are expected to be useful to change the wettability of surfaces downhole, such as filter cakes, drill cuttings, wellbore surfaces, deposits which cause stuck pipe (primarily filter cakes, but other deposits may also cause problems). Such wettability changes, for instance from water-wet to oil-wet would be useful as oil-wetting additives. Such bifunctional nanoparticles may be used alone or together with conventional surfactants, co-surfactants and/or co-solvents.

Suitable functionalized polymers herein include, but are not necessarily limited to, iodododecane-functionalized vinylpyrrolidone/vinylimidazole copolymers, sulfonated-functionalized vinylpyrrolidone/vinylimidazole copolymers, sulfonated polyether ether ketones (PEEK), imidazole polymers, imidazole copolymers, 3-(1-pyridino)-1-propanesulfonate, poly(ethylene glycol) diamine, polyethyleneimine, polydimethoxysiloxane, deformable polymer latex, and octadecylphosphonic acid and combinations thereof. Besides sulfonate and iodododecane functionality, other functionalities that would be expected to work include, but are not necessarily limited to, phosphonates, phosphates, amines, imines, amides, and combinations of these. Suitable polymer molecular weights, before being functionalized include, but are not necessarily limited to, a number average molecular weight (Mn) of from about 100 independently to about 100,000; alternatively, from about 500 independently to about 25,000; and in a different non-restrictive version from about 150 to about 15,000.

The additive component (functionalized polymer or nanoparticle, considered alone or together as a whole) may be added to the crude oil, the wash water, or the emulsion formed after the wash water and crude oil are mixed together. In one non-limiting embodiment, the additive component is introduced into the emulsion. The amount of the additive component (again, functionalized polymer or nanoparticle, considered alone or together as a whole) introduced to the oil/water mixture (created emulsion) may range from about 1 ppm independently to about 5000 ppm; in a different non-limiting embodiment from about 10 ppm independently to about 1000 ppm; alternatively, from about 20 ppm independently to about 250 ppm; and in another non-restrictive version from about 30 to about 100 ppm.

Some of the additive compositions containing the oil-wetting additives described above have been found to benefit by including an optional demulsifier. Beneficial optional demulsifiers include, but are not necessarily limited to, oxyalkylated alkyl phenolic resins. Two specific suitable examples include a blend of a nonylphenol resin oxyalkylate with a p-t-amylphenol resin oxyalkylated and blends of a nonylphenol resin oxyalkylate with a p-t-butylphenol resin oxyalkylate. Different common aromatic solvents may be used in the demulsifier blends. The amount of optional demulsifier may range from about 30 ppm independently to about 1000 ppm based on the mixture of a hydrocarbon phase and an aqueous phase in one non-limiting embodiment; alternatively, from about 100 ppm independently to about 500 ppm.

The solid contaminants that are treated in the methods described herein may generally be metals, salts, solids other than salts, and combinations thereof. The solid salts may be, but are not necessarily, metal salts. Solid metal salts that partitioned by the methods herein include, but are not necessarily limited to, salts of metals of calcium, iron, zinc, silicon, nickel, sodium and potassium. The partitioning of particulate iron in the form of iron oxide, iron sulfide, etc. is a specific, non-limiting embodiment of the method. By "removing" the iron species in the hydrocarbon or crude is meant any and all mobilization, partitioning, sequestering, separating, transferring, eliminating, dividing, of one or more metal from the hydrocarbon or crude to any extent. Asphaltenes may also be the solids treated by the method herein. Additionally, solid corrosive components including, but not necessarily limited to, inorganic acids, organic acids, salts, and combinations thereof may be oil-wet in the methods described herein.

While a goal of the method described herein is to remove all (100%) of the metal contaminants from the hydrocarbon phase, in one non-limiting successful embodiment at least 40 wt % of the solid contaminants are removed in the hydrocarbon phase. Alternatively, at least 85 wt % of the solid contaminants are removed, and in a different non-restrictive version at least 90 wt % of the contaminants are removed in the hydrocarbon phase.

The invention will be illustrated further with reference to the following Examples, which are not intended to limit the invention, but instead illuminate it further. Throughout this specification, proportions are on a weight basis unless otherwise noted.

EXAMPLES

The Electrical Desalting Dehydration Apparatus (EDDA) is a laboratory instrument used to model a desalter. The EDDA is a batch process that applies an electrical field to oil-water emulsion samples in tubes that are inserted into a cell. The temperature and voltage are controlled to model the same conditions that the crude oil is under in a refinery. The EDDA allows for eight different crude oil samples to be treated in one test run with different chemicals for demulsification and contaminant removal. The EDDA in previous projects has been proven to effectively model a desalter even though a batch process is being to use to model a continuous process.

The standard operating procedure (SOP) for the EDDA was used in this study. Data for filterable solids, basic sediment and water (BS&W), and elements were obtained by a XOS Petra Max laboratory analyzer after each experiment. The Petra Max laboratory instrument uses high-definition x-ray fluorescence (HDXRF) for detection of a spectrum of elements. The accuracy of the Petra Max is comparable to the inductively coupled plasma (ICP) mass spectrometry.

Several different crude oils were utilized in the screening of various chemicals during this research.

Table I presents a detailed description of the partitioning additives that were used in this research.

TABLE 1

Candidates for Removing Metals from Crude Oil

| Name | Additive Description |
|---|---|
| A | Polyalkylsuccinic imide base |
| B | Polyalkylsuccinic imide |
| C | Vinyl polymer base |
| D | Alkylphenol fatty acid amine condensate |
| E | Iodododecane-functionalized vinylpyrrolidone/vinylimidazole copolymer |

The demulsifier used in the Examples herein was a blend of a nonylphenol resin oxyalkylate with a p-t-butylphenol resin oxyalkylated with an aromatic solvent.

Examples 1-7

Solids Mobilization Additives for Desalter

For the results of Tables II and III, the EDDA was employed instead of capped bottles to simulate solids settling at high temperature, between about 100 to about 150° C., which would otherwise boil water. Production systems and vessels are typically pressurized, usually to 8 bar in a first stage (0.8 MPa) and to 4 bar in a second stage (0.4 MPa). These EDDA tests are simulations, and are at less than 8 bar (0.8 MPa). This test screened six potential solids mobilization additive at 60 ppm-v. This solids mobilization additive candidates were as noted in Table I. The test included the demulsifier as an aid.

A Michigan crude oil was mixed with 5%-v wash water in a blender set to simulate approximately 12 psig (83 kilopascal) mix value pressure. After mixing, the emulsion was poured into separate EDDA test tubes with each test tube representing a blank or one of the solids mobilization additives. After dosing with the appropriate solids mobilization additive candidate and the demulsifier at 30 ppm-v, the EDDA test tubes were capped and placed into the EDDA heater block set to attain 212° F. (100° C.) in the test tubes. After 15 minutes at temperature, The EDDA test tubes were removed from the heater block and allowed to cool to room temperature. After uncapping each EDDA test tube, 50 ml of the diesel fuel from an EDDA test tube was mixed with 50 ml of xylenes. The sample solution was heated and passed through a 0.45 μm Millipore PVDF membrane filter. The filter was washed with additional 50 ml of hot xylene.

Table II displays the filterable solids, BS&W % and solids results for the sample aliquots of the untreated or treated Michigan crude oil pre-mixed with 5%-v wash water removed after settling for 15 minutes at 212° F. (100° C.). "Ptb" refers to pounds per thousand barrels.

TABLE II

Separation Results for Examples 1-7

| Ex. | Additive | BS&W % | Solids % | Filterable Solids (ptb) |
|---|---|---|---|---|
| 1 | A | 1.4 | 0 | 50 |
| 2 | B | 1.5 | 0 | 51 |
| 3 | C | 1.6 | 0 | 36 |
| 4 | D | 1.8 | 0 | 34 |
| 5 | E | 1.4 | 0 | 34 |
| 6 | Blank | 2.8 | 0 | 22 |
| 7 | Raw crude | 0.5 | 0.2 | 55 |

Raw Crude Metal Concentration Analysis (ppm)

| Sulfur | Chlorine | Potassium | Calcium | Vanadium |
|---|---|---|---|---|
| 30,7333 | 4.21 | 1.81 | 5.60 | 127 |
| **Chromium** | **Iron** | **Nickel** | **Copper** | **Zinc** |
| 2.47 | 7.97 | 42.88 | 0.62 | 2.59 |

Metals Analysis using XOS Petra Max analyzer.

Table III, below, reports the metal concentrations measured in the sample aliquots of the untreated or treated Michigan crude pre-mixed with 5% wash water removed after settling for 15 minutes at 212° F. (100° C.) temperature.

TABLE III

Michigan Crude Oil Treatment with Additives A, B, C, D and E
Dosage of Solids Mobilization Additive at 30 ppm-v and Demulsifier at 30 ppm-v
Testing with 5% Water Added and with EDDA

| Element | Ex. | 1 Candidate A | 2 Candidate B | 3 Candidate C | 4 Candidate D | 5 Candidate E |
|---|---|---|---|---|---|---|
| S | ppm | 26,942 | 29,830 | 29,785 | 29,675 | 29,681 |
| Cl | ppm | <3.75 | <3.90 | <3.87 | <3.92 | <3.76 |
| K | ppm | 0.94 | <0.88 | <0.84 | <0.85 | <0.87 |
| Ca | ppm | 0.77 | <0.54 | 1.28 | <0.54 | <0.54 |
| V | ppm | 114 | 125 | 125 | 124 | 124 |
| Cr | ppm | 2.50 | 2.14 | 2.01 | 2.51 | 2.15 |
| Fe | ppm | 6.40 | 4.86 | 4.30 | 4.83 | 3.53 |
| Ni | ppm | 40.58 | 41.65 | 41.56 | 41.56 | 41.37 |
| Cu | ppm | 0.51 | 0.62 | 0.56 | 0.58 | 0.64 |
| Zn | ppm | 1.94 | 2.59 | 2.41 | 2.26 | 2.56 |

It can be seen that Candidate E in Example 5 had the lowest resulting iron and was thus the best performer. FIG. 1 is a photograph of the EDDA test tubes showing water separation for Examples 1 through 6, left to right, where the following dosages were used: Candidate A—30 ppm-v, Candidate B—6 ppm-v, Candidate C—30 ppm-v, Candidate D—30 ppm-v, Candidate E—30 ppm-v, Blank=demulsifier=30 ppm-v.

Examples 8-14

Solids Mobilization Additives for Desalter

For the results of Tables IV and V, the EDDA was employed instead of capped bottles to simulate solids settling at high temperature, 212° F. (100° C.), which would otherwise boil water. This test screened six potential solids mobilization additive at 60 ppm-v. This solids mobilization additive candidates were as noted in Table I. The test included the demulsifier as an aid.

A Utah crude oil was mixed with 5%-v wash water in a blender set to simulate approximately 12 psig (83 kilopascal) mix value pressure. After mixing, the emulsion was poured into separate EDDA test tubes with each test tube representing a blank or one of the solids mobilization additives. After dosing with the appropriate solids mobilization additive candidate and the demulsifier at 30 ppm-v, the EDDA test tubes were capped and placed into the EDDA heater block set to attain 212° F. (100° C.) in the test tubes. After 15 minutes at temperature, The EDDA test tubes were removed from the heater block and allowed to cool to room temperature. After uncapping each EDDA test tube, 50 ml of the diesel fuel from an EDDA test tube was mixed with 50 ml of xylenes. The sample solution was heated and passed through a 0.45 μm Millipore PVDF membrane filter. The filter was washed with additional 50 ml of hot xylene.

Table IV displays the filterable solids, BS&W % and solids results for the sample aliquots of the untreated or treated Utah crude oil pre-mixed with 5%-v wash water removed after settling for 15 minutes at 212° F. (100° C.).

TABLE IV

Separation Results for Examples 1-7

| Ex. | Additive | BS&W % | Solids % | Filterable Solids (ptb) |
|---|---|---|---|---|
| 8 | A | 0.2 | 0 | 28 |
| 9 | B | 0.4 | 0 | 31 |

TABLE IV-continued

Separation Results for Examples 1-7

| | | | | |
|---|---|---|---|---|
| 10 | C | 0.4 | 0 | 17 |
| 11 | D | 0.2 | 0 | 34 |

TABLE IV-continued

| Separation Results for Examples 1-7 | | | | |
|---|---|---|---|---|
| 12 | E | 0.4 | 0 | 34 |
| 13 | Blank | 0.4 | 0 | 35 |
| 14 | Raw crude | 0.3 | 0.2 | 45 |

| Raw Crude Metal Concentration Analysis (ppm) | | | | |
|---|---|---|---|---|
| Sulfur | Chlorine | Potassium | Calcium | Vanadium |
| 3,960 | 7.23 | 0.75 | 1.13 | 10.53 |
| Chromium | Iron | Nickel | Copper | Zinc |
| 0.36 | 4.86 | 4.41 | 0.42 | 4.29 |

Metals Analysis using XOS Petra Max analyzer.

Table V, below, reports the metal concentrations measured in the sample aliquots of the untreated or treated Utah crude pre-mixed with 5% wash water removed after settling for 15 minutes at 212° F. (100° C.) temperature.

TABLE V

Utah Crude Oil Treatment with Additives A, B, C, D, and E
Dosage of Solids Mobilization Additive at 30 ppm-v and Demulsifier at 30 ppm-v
Testing with 5% Water Added and with EDDA

| Element | Ex. | 8 Candidate A | 9 Candidate B | 10 Candidate C | 11 Candidate D | 12 Candidate E | 13 Blank |
|---|---|---|---|---|---|---|---|
| S | ppm | 3,912 | 3,941 | 3,913 | 3,960 | 3,942 | 3,935 |
| Cl | ppm | 6,90 | 4.66 | <2.85 | 4.79 | 5.77 | 4.66 |
| K | ppm | 0.81 | 0.93 | <0.64 | 1.11 | <0.65 | 1.18 |
| Ca | ppm | <0.39 | <0.38 | <0.38 | <0.40 | <0.39 | <0.39 |
| V | ppm | 10.20 | 10.31 | 10.51 | 10.24 | 10.26 | 10.14 |
| Cr | ppm | 0.48 | 0.32 | 0.41 | 0.44 | 0.32 | 0.41 |
| Fe | ppm | 1.34 | 1.13 | 0.90 | 2.07 | 0.48 | 0.93 |
| Ni | ppm | 4.22 | 4.29 | 4.26 | 4.34 | 4.23 | 4.25 |
| Cu | ppm | 0.45 | 0.42 | 0.46 | 0.48 | 0.45 | 0.42 |
| Zn | ppm | 4.03 | 3.99 | 4.00 | 4.01 | 3.88 | 3.87 |

Figure 2:
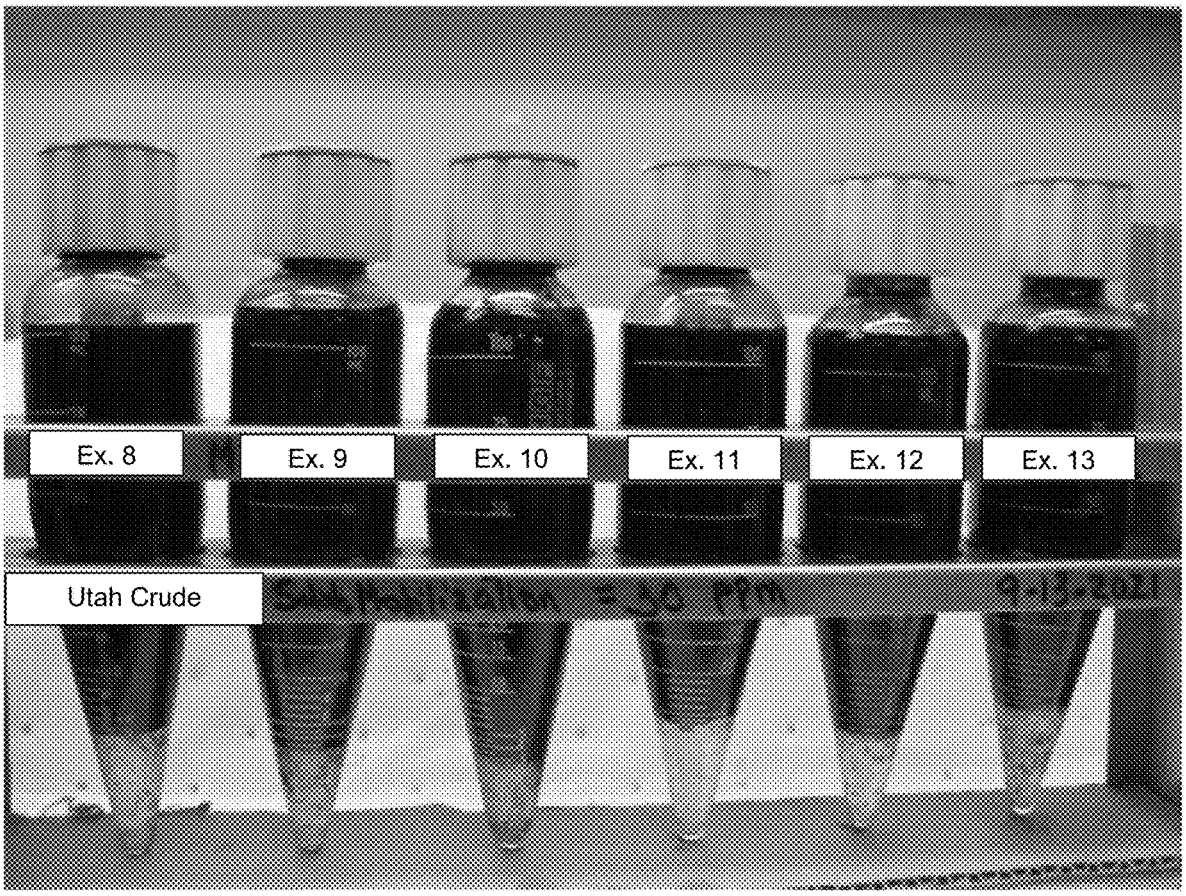
FIG. 2 is a photograph of the EDDA test tubes showing water separation for Examples 8 through 13.

It can be seen that Candidate E in Example 12 had the lowest resulting iron and was thus again the best performer. FIG. 2 is a photograph of the EDDA test tubes showing water separation for Examples 8 through 13, left to right, where the following dosages were used: Candidate A—30 ppm-v, Candidate B—6 ppm-v, Candidate C—30 ppm-v, Candidate D—30 ppm-v, Candidate E—60 ppm-v, Blank=demulsifier=30 ppm-v.

Examples 15-21

Solids Mobilization Additives for Desalter

For the results of Tables VI and VII, the EDDA was employed instead of capped bottles to simulate solids settling at high temperature, 212° F. (100° C.), which would otherwise boil water. This test screened six potential solids mobilization additive at 60 ppm-v. This solids mobilization additive candidates were as noted in Table I. The test included the demulsifier as an aid.

A Texas crude oil was mixed with 5%-v wash water in a blender set to simulate approximately 12 psig (83 kilopascal) mix value pressure. After mixing, the emulsion was poured into separate EDDA test tubes with each test tube representing a blank or one of the solids mobilization additives. After dosing with the appropriate solids mobilization additive candidate and the demulsifier at 30 ppm-v, the EDDA test tubes were capped and placed into the EDDA heater block set to attain 212° F. (100° C.) in the test tubes. After 15 minutes at temperature, The EDDA test tubes were removed from the heater block and allowed to cool to room temperature. After uncapping each EDDA test tube, 50 ml of the diesel fuel from an EDDA test tube was mixed with 50 ml of xylenes. The sample solution was heated and passed through a 0.45 μm Millipore PVDF membrane filter. The filter was washed with additional 50 ml of hot xylene.

Table VI displays the filterable solids, BS&W % and solids results for the sample aliquots of the untreated or treated Texas crude oil pre-mixed with 5%-v wash water removed after settling for 15 minutes at 212° F. (100° C.).

TABLE VI

| Separation Results for Examples 15-21 | | | | |
|---|---|---|---|---|
| Ex. | Additive | BS&W % | Solids % | Filterable Solids (ptb) |

TABLE VI-continued

| Separation Results for Examples 15-21 | | | | |
|---|---|---|---|---|
| 15 | A | 1.6 | 0 | 36 |
| 16 | B | 1.8 | 0 | 34 |
| 17 | C | 1.7 | 0 | 42 |
| 18 | D | 1.4 | 0 | 39 |
| 19 | E | 1.9 | 0 | 29 |
| 20 | Blank | 1.4 | 0 | 21 |
| 21 | Raw crude | 0.3 | 0.2 | 43 |

| Raw Crude Metal Concentration Analysis (ppm) | | | | |
|---|---|---|---|---|
| Sulfur | Chlorine | Potassium | Calcium | Vanadium |
| 12,627 | 4.28 | 1.17 | <0.45 | 22.53 |
| Chromium | Iron | Nickel | Copper | Zinc |
| 0.60 | 3.15 | 7.90 | 0.49 | 5.18 |

Metals Analysis using XOS Petra Max analyzer.

Table VII, below, reports the metal concentrations measured in the sample aliquots of the untreated or treated Texas crude pre-mixed with 5% wash water removed after settling for 15 minutes at 212° F. (100° C.) temperature.

TABLE III

Texas Crude Oil Treatment with Additives A, B, C, D and E
Dosage of Solids Mobilization Additive at 30 ppm-v and Demulsifier at 30 ppm-v
Testing with 5% Water Added and with EDDA

| Element | Ex. | 15 Candidate A | 16 Candidate B | 17 Candidate C | 18 Candidate D | 19 Candidate E | 20 Blank |
|---|---|---|---|---|---|---|---|
| S | ppm | 23,607 | 23,637 | 23,214 | 23,547 | 23,223 | 23,202 |
| Cl | ppm | <3.87 | <3.80 | <3.75 | <3.79 | <3.65 | <3.63 |
| K | ppm | 0.94 | <0.82 | <0.81 | 1.28 | <0.81 | 1.26 |
| Ca | ppm | <0.51 | <0.52 | <0.51 | <0.50 | <0.49 | <0.50 |
| V | ppm | 43.31 | 42.94 | 42.83 | 43.26 | 42.65 | 43.32 |
| Cr | ppm | 0.88 | 0.99 | 1.02 | 0.79 | 0.83 | 0.93 |
| Fe | ppm | 4.40 | 3.48 | 4.47 | 4.97 | 2.83 | 3.43 |
| Ni | ppm | 14.29 | 14.47 | 14.34 | 14.30 | 14.42 | 14.32 |
| Cu | ppm | 0.39 | 0.45 | 0.41 | 0.41 | 0.40 | 0.34 |
| Zn | ppm | 4.89 | 4.81 | 4.57 | 4.95 | 4.02 | 4.13 |

Figure 3:
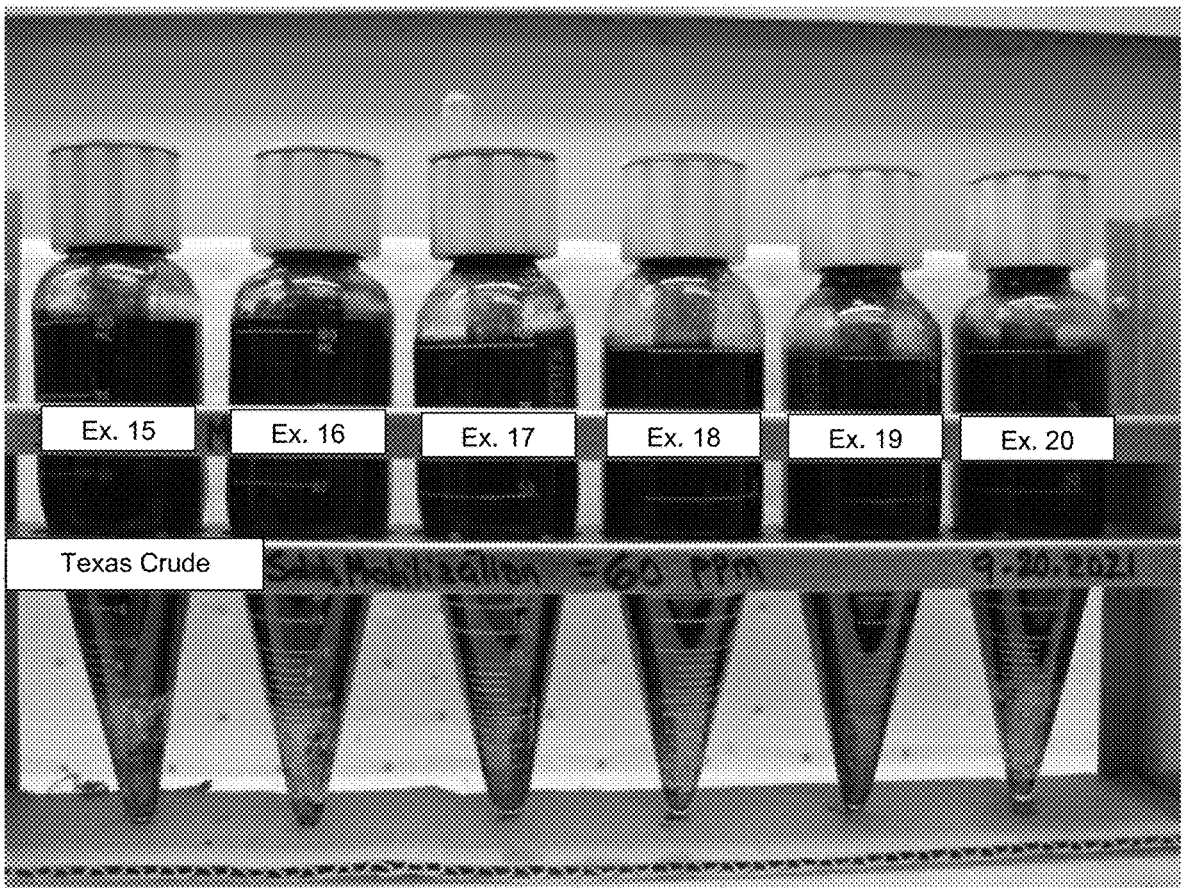
FIG. 3 is a photograph of the EDDA test tubes showing water separation for Examples 15 through 20.

It can be seen that Candidate E in Example 19 had the lowest resulting iron and was thus the best performer. FIG. 3 is a photograph of the EDDA test tubes showing water separation for Examples 15 through 20, where the following dosages were used: Candidate A—60 ppm-v, Candidate B—12 ppm-v, Candidate C—60 ppm-v, Candidate D—60 ppm-v, Candidate E—60 ppm-v, Blank=demulsifier=60 ppm-v.

Figure 4:
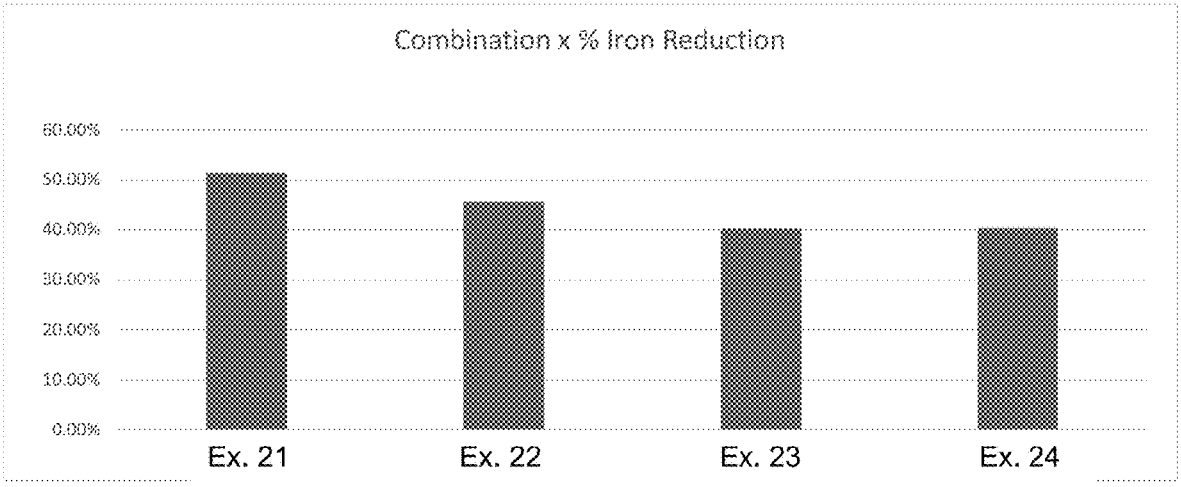
FIG. 4 is a bar graph of the percentage of iron reduction in a crude using combinations of functionalized polymers and functionalized nanoparticles.

Shown in Table IV and FIG. 4 are the results of using nanoparticles together with polymers to successfully remove iron from crude oil, run as EDDA Examples. "PEEK" refers to polyether ether ketones. All of the PEEK additives of Examples 21-24 are sulfonated. Examples 21-24 each used total additive dosages between about 30 to about 100 ppm.

TABLE IV

Combinations of Active Additives for Iron Reduction

| Ex. | Additive 1 | Additive 2 | % Iron Reduction |
|---|---|---|---|
| 21 | sulfonated PEEK | sulfonated vinylimidazole/ vinyl pyrrolidone copolymer, sulfonated vinylimidazole polymer | 51.29 |
| 22 | sulfonated vinylimidazole/ vinyl pyrrolidone copolymer, sulfonated vinylimidazole polymer | 3-(1-pyridino)-1-propanesulfonate | 46 |
| 23 | sulfonated PEEK | graphene oxide, ammonia functionalized | 40.20 |
| 24 | sulfonated PEEK | graphene, $TiO_2$ functionalized | 40.33 |

In the foregoing specification, the invention has been described with reference to specific embodiments thereof, and has been demonstrated as effective in transferring or mobilizing metal contaminants into the aqueous phase from a mixture of a hydrocarbon phase and an aqueous phase, as non-limiting examples. However, it will be evident that various modifications and changes can be made thereto without departing from the broader scope of the invention as set forth in the appended claims. Accordingly, the specification is to be regarded in an illustrative rather than a restrictive sense. For example, specific mixtures of hydrocarbon phases and aqueous phases, nanoparticles, functionalized polymers, demulsifiers, dosages, and solids other than those specifically exemplified or mentioned, or in different proportions, falling within the claimed parameters, but not specifically identified or tried in a particular application to transfer metals into the aqueous phase, are within the scope of the method and compositions described herein. Similarly, it is expected that the inventive compositions will find utility as mobilizing additives in other methods besides refinery desalting.

The present invention may suitably comprise, consist of or consist essentially of the elements disclosed and may be practiced in the absence of an element not disclosed. For instance, there may be provided a method for removing metals from crude oil comprising, consisting essentially of, or consisting of adding to crude oil, a wash water, or an emulsion created by the mixing of crude oil with wash water, an effective amount of an additive composition to transfer metal contaminants from a hydrocarbon phase to an aqueous phase, the additive composition comprising an active additive selected from the group consisting of nanoparticles, functionalized polymers, and combinations thereof; and resolving the emulsion into the hydrocarbon phase and the aqueous phase in a refinery desalting process using electrostatic coalescence, where at least a portion of the metal contaminants are transferred to the aqueous phase.

There may be further provided a treated mixture comprising, consisting essentially of, or consisting of a hydrocarbon phase, an aqueous phase, metal contaminants, and an effective amount of an additive composition comprising an active additive selected from the group consisting of nanoparticles, functionalized polymers, and combinations thereof.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and do not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

What is claimed is:

1. A method for removing metal from crude oil comprising:

adding to crude oil, a wash water, or an emulsion created by the mixing of crude oil with wash water, an effective amount of an additive composition to transfer a metal contaminant from a hydrocarbon phase to an aqueous phase, the additive composition comprising an active additive selected from the group consisting of nanoparticles, functionalized polymers, and combinations thereof where the nanoparticles are selected from the group consisting of graphene oxide, titanium dioxide, zinc oxide, aluminum nitride, aluminum oxide, functionalized clays, deformable polymer latex, magnesium oxide, barium sulfate, polydimethylsiloxane, functionalized silica, ammonia-functionalized graphene oxide, $TiO_2$-functionalized graphene, and combinations thereof, and where the functionalized silica is functionalized with a functional group selected from the group consisting of sulfonate, sulfate, sulfosuccinate, thiosulfate, succinate, carboxylate, hydroxyl, glucoside, ethoxylate, propoxylate, phosphate, phosphonate, ethoxylate, ether, amines, amides and combinations thereof, and where the functionalized polymers are selected from the group consisting of iodododecane-functionalized vinylpyrrolidone/vinylimidazole copolymers, sulfonated-functionalized vinylpyrrolidone/vinylimidazole copolymers, sulfonated polyether ether ketones, imidazole polymers, imidazole copolymers, 3-(1-pyridino)-1-propanesulfonate, sulfonated vinylimidazole/vinyl pyrrolidone copolymer, sulfonated vinylimidazole polymer, poly(ethylene glycol) diamine, octadecylphosphonic acid, polydimethoxysiloxane, deformable polymer latex, and combinations thereof; and resolving the emulsion into the hydrocarbon phase and the aqueous phase in a refinery desalting process using electrostatic coalescence, where at least a portion of the metal contaminant is transferred to the aqueous phase.

2. The method of claim 1 where the functionalized polymers have a number average molecular weight of from about 100 to about 100,000.

3. The method of claim 1 where the effective amount of the active additives ranges from about 1 ppm to about 5000 ppm, based on the created emulsion.

4. The method of claim 1 where the metal contaminant is iron or salts thereof.

5. The method of claim 1 where the additive composition comprises a demulsifier.

6. A method for removing metal from crude oil comprising:

adding to crude oil, a wash water, or an emulsion created by the mixing of crude oil with wash water, an effective amount of an additive composition to transfer a metal contaminant from a hydrocarbon phase to an aqueous phase, where the metal contaminant is iron or salts thereof, the additive composition comprising an active additive selected from the group consisting of nanoparticles, functionalized polymers, and combinations thereof;

where the nanoparticles are selected from the group consisting of graphene oxide, titanium dioxide, zinc oxide, aluminum nitride, aluminum oxide, functionalized clays, functionalized silica, magnesium oxide, barium sulfate, ammonia-functionalized graphene oxide, $TiO_2$-functionalized graphene, and combinations thereof, and where the functionalized silica is functionalized with a functional group selected from the group consisting of sulfonate, sulfate, sulfosuccinate, thiosulfate, succinate, carboxylate, hydroxyl, glucoside, ethoxylate, propoxylate, phosphate, phosphonate, ethoxylate, ether, amines, amides and combinations thereof, and;

where the functionalized polymers are selected from the group consisting of iodododecane-functionalized vinylpyrrolidone/vinylimidazole copolymers, sulfonated-functionalized vinylpyrrolidone/vinylimidazole copolymers, sulfonated polyether ether ketones, imidazole polymers, imidazole copolymers, 3-(1-pyridino)-1-propanesulfonate, sulfonated vinylimidazole/vinyl pyrrolidone copolymer, sulfonated vinylimidazole polymer, poly(ethylene glycol) diamine, octadecylphosphonic acid, deformable polymer latex, polydimethylsiloxane, and combinations thereof;

where the effective amount of each active additive ranges from about 1 ppm to about 5000 ppm, based on the created emulsion resolving the emulsion into the hydrocarbon phase and the aqueous phase in a refinery desalting process using electrostatic coalescence, where at least a portion of the metal contaminant is transferred to the aqueous phase.

7. The method of claim 6 where the functionalized polymers have a number average molecular weight of from about 100 to about 100,000.

8. The method of claim 6 where the additive composition comprises a demulsifier.

9. A treated mixture comprising:

a hydrocarbon phase;

an aqueous phase;

a metal contaminant; and an effective amount of an additive composition comprising an active additive selected from the group consisting of nanoparticles, functionalized polymers, and combinations thereof where the nanoparticles are selected from the group consisting of graphene oxide, titanium dioxide, zinc oxide, aluminum nitride, aluminum oxide, functionalized clays, deformable polymer latex, magnesium oxide, barium sulfate, polydimethylsiloxane, functionalized silica, ammonia-functionalized graphene oxide, $TiO_2$-functionalized graphene, and combinations thereof, and where the functionalized silica is functionalized with a functional group selected from the group consisting of sulfonate, sulfate, sulfosuccinate, thiosulfate, succinate, carboxylate, hydroxyl, glucoside, ethoxylate, propoxylate, phosphate, phosphonate, ethoxylate, ether, amines, amides and combinations thereof, and where the functionalized polymers are selected from the group consisting of iodododecane-functionalized vinylpyrrolidone/vinylimidazole copolymers, sulfonated-functionalized vinylpyrrolidone/vinylimidazole copolymers, sulfonated polyether ether ketones, imidazole polymers, imidazole copolymers, 3-(1-pyridino)-1-propanesulfonate, sulfonated vinylimidazole/vinyl pyrrolidone copolymer, sulfonated vinylimidazole polymer, poly(ethylene glycol) diamine, octadecylphosphonic acid, polydimethoxysiloxane, deformable polymer latex, and combinations thereof.

10. The treated mixture of claim 9 where the functionalized polymers have a number average molecular weight of from about 100 to about 100,000.

11. The treated mixture of claim 9 where the effective amount of the active additive ranges from about 1 ppm to about 5000 ppm, based on the mixture.

12. The treated mixture of claim 9 where the metal contaminant is iron or salts thereof.

13. The treated mixture of claim 9 where the additive composition comprises a demulsifier.

14. The treated mixture of claim 13 where the amount of demulsifier ranges from about 30 ppm to about 1000 ppm.

15. The treated mixture of claim 9 where the hydrocarbon phase is crude oil.

* * * * *